United States Patent [19]

Anderson

[11] Patent Number: 4,750,297

[45] Date of Patent: Jun. 14, 1988

[54] GRINDING APPARATUS AND METHOD

[76] Inventor: William J. Anderson, 330 SE. Spokane St., Portland, Oreg. 97202

[21] Appl. No.: 333,789

[22] Filed: Dec. 23, 1981

[51] Int. Cl.[4] ..... B24B 21/10

[52] U.S. Cl. ..... 51/135 R; 51/141; 51/356

[58] Field of Search ..... 51/135 R, 135 BT, 143, 51/356, 357, 240 R, 141, 266, 170 EB

[56] References Cited

U.S. PATENT DOCUMENTS

| | | | |
|---|---|---|---|
| 557,462 | 3/1896 | Wenchel | 51/135 R |
| 685,328 | 10/1901 | Gale | 51/135 R |
| 711,397 | 10/1902 | Gronvold . | |
| 1,036,783 | 8/1912 | Bein | 51/135 R |
| 1,064,572 | 6/1913 | Trogdon | 51/141 |
| 1,094,484 | 4/1914 | Sellner | 51/141 |
| 1,191,045 | 7/1916 | Verwer . | |
| 1,496,471 | 6/1924 | Lane | 51/141 |
| 1,913,503 | 6/1933 | Myers | 51/170 EB |
| 2,199,069 | 4/1940 | Fowler | 51/170 EB |
| 2,586,848 | 2/1952 | Miller . | |
| 2,624,160 | 1/1953 | Harper | 51/141 |
| 2,679,128 | 5/1954 | Miller . | |
| 2,762,173 | 9/1956 | Böttcher | 51/141 |
| 3,266,197 | 8/1966 | Olton . | |
| 3,801,293 | 4/1974 | Kiser . | |
| 4,290,240 | 9/1981 | Robinson . | |
| 4,294,044 | 10/1981 | Hansen . | |

FOREIGN PATENT DOCUMENTS

| | | | |
|---|---|---|---|
| 0013061 | of 1929 | Australia | 51/135 R |
| 0144646 | 12/1948 | Australia | 51/135 R |
| 0457250 | 3/1928 | Fed. Rep. of Germany | 51/170 EB |
| 2608730 | 9/1977 | Fed. Rep. of Germany | 51/141 |

*Primary Examiner*—Frederick R. Schmidt
*Assistant Examiner*—Robert A. Rose
*Attorney, Agent, or Firm*—Klarquist, Sparkman, Campbell, Leigh & Whinston

[57] ABSTRACT

An abrasive belt grinder is provided which includes the following components: (1) a pair of parallel, spaced rollers mounted to a table; (2) an endless abrasive belt mounted between the rollers, the upper portion of the belt defining a substantially planar grinding surface; and (3) a platen fixedly mounted under the upper portion of the abrasive belt to provide support for the workpiece, the platen including a plurality of parallel slots which are angled with respect to the direction of travel of the abrasive belt to facilitate cooling of the platen.

Another aspect of the invention is a method for grinding a workpiece on an abrasive belt grinder which includes the step of placing a workpiece on the grinding surface to initiate grinding of the underside of the workpiece, displacing the workpiece from side to side along the grinding surface so that grinding is effected in a uniform fashion, and cooling the platen and the workpiece by permitting cooling fluid to circulate between the bars of the platen while grinding is taking place.

3 Claims, 1 Drawing Sheet

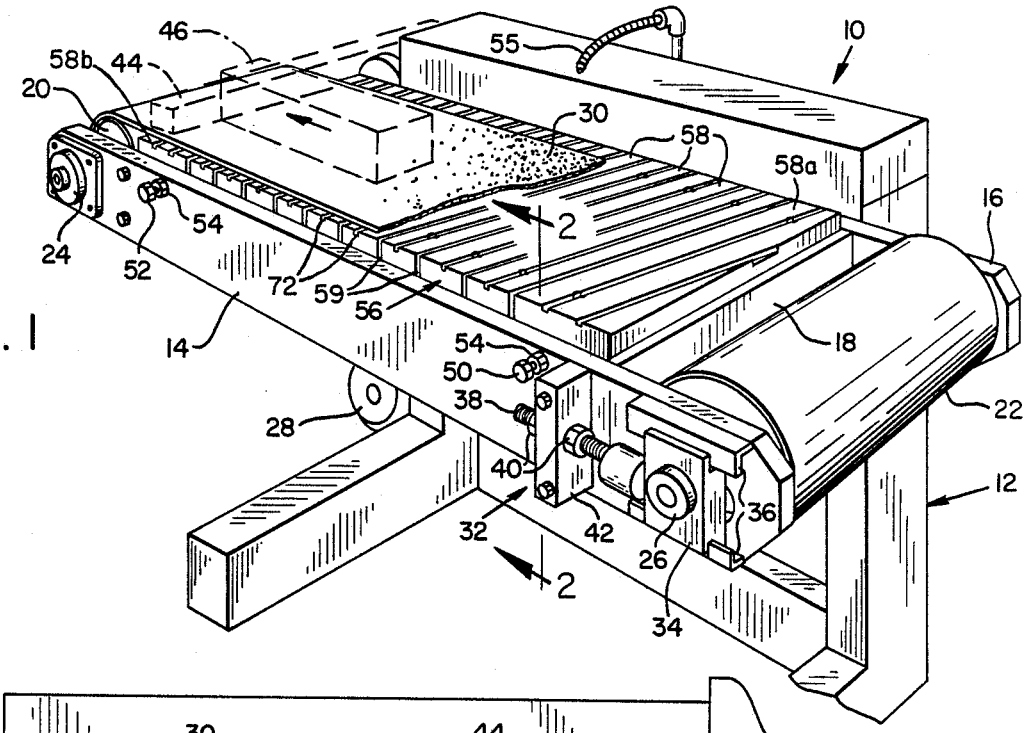
FIG. 1
FIG. 2
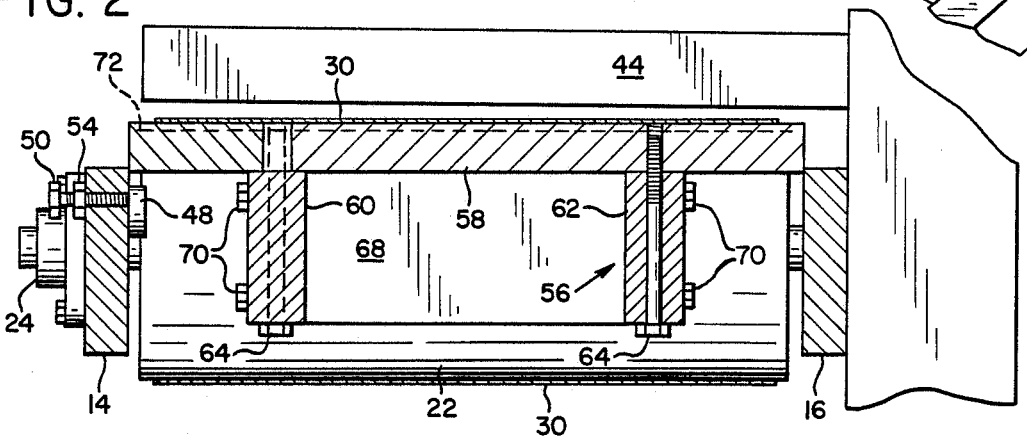
FIG. 3
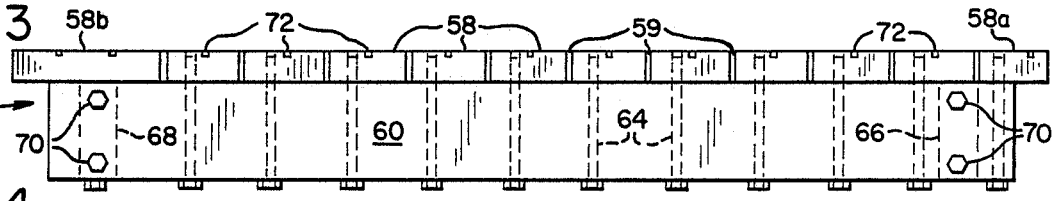
FIG. 4
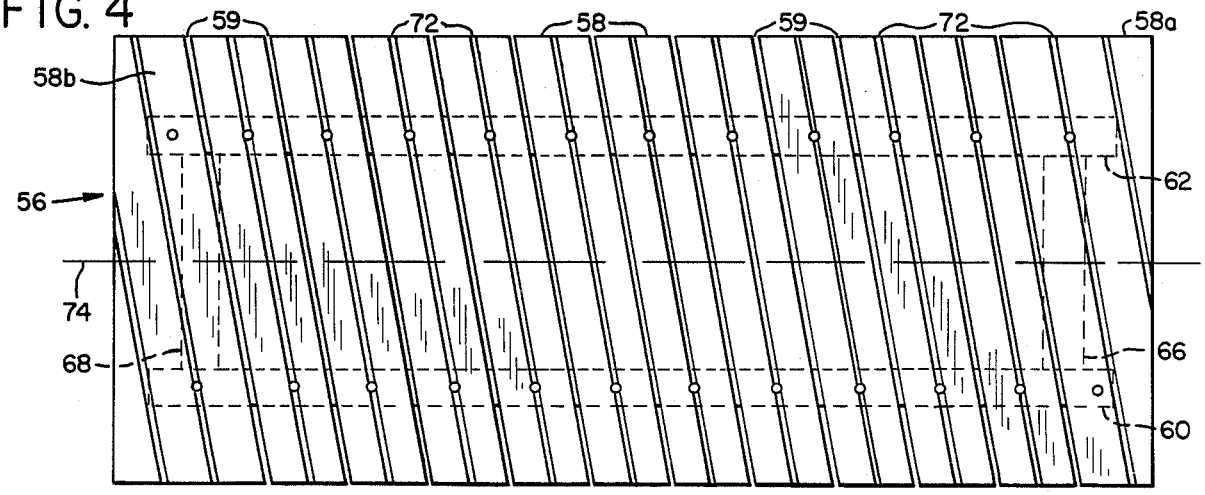

GRINDING APPARATUS AND METHOD

BACKGROUND OF THE INVENTION

1. The Field of the Invention

The invention relates generally to belt grinders and more particularly to an apparatus and method for grinding a workpiece using an endless abrasive belt and a novel platen design.

2. Description of the Prior Art

Conventional belt grinders typically include an endless abrasive belt mounted between a pair of substantially horizontal, spaced rollers, at least one of which is rotatably driven. The upwardly facing portion of the belt defines a substantially planar grinding surface. To support the workpiece to be ground, a platen is disposed immediately below the grinding surface.

Belt grinders of this design perform relatively well in a wide variety of grinding usages. However, one problem in connection with conventional belt grinders is that there is a great deal of heat which is generated during the grinding process which is not easily dissipated. The heat generated on the ground surface of the workpiece is typically greater at the center than at the periphery so that during the grinding process, uneven thermal expansion of the workpiece often results in more material being ground off near the center of the workpiece than at the periphery. Thus, when the workpiece has cooled, its ground surface will be somewhat concave or dished.

This uneven grinding can be compounded by possible bowing of the platen, also resulting from concentration of heat in the central region thereof.

While this lack of flatness in the ground workpiece often is not great enough to be of concern, it has typically prevented belt grinders from being used for precision grinding operations. One solution is proposed in U.S. Pat. No. 3,801,293 to Kiser, in which a two-stage grinding process is suggested. The first stage consists of achieving a rough grind on the workpiece using a grinder of conventional design. Appreciating that the uneven thermal expansion will cause the ground surface to be dished, Kiser proposes permitting the workpiece to cool after the rough grind and then performing a final, precision grind, utilizing an abrasive belt grinder with a magnetic platen having a magnetic field which increases in strength at its downstream or trailing edge. That is, to avoid the problem common in other types of belt grinders which causes more grinding to take place adjacent the leading edge of the workpiece, Kiser proposes the use of a strong magnetic attraction adjacent the trailing edge of the workpiece. Kiser's second stage grinder has an abrasive belt with a fine grit to minimize the heat in the workpiece and thereby remove the dished out effect caused during the initial rough grinding operation.

While Kiser's design may have a tendency to minimize the uneven grinding caused by unequal thermal expansion of the workpiece, such expansion is still possible due to the absence of any means for dissipating heat from the central portions of the workpiece. Moreover, Kiser's two-stage grinding operation is obviously time consuming and requires two separate belt grinders. Also, because of his magnetic platen, it is only suitable for use with a ferrous metal workpiece. In short, Kiser realized that concentration of heat at the center of the workpiece was the problem, but tried to solve that problem without really addressing the reason for the build up of heat; that is, the lack of sufficient means to dissipate heat at the central regions of the ground surface of the workpiece.

In addition to the uneven grinding resulting from the heating effects of the platen and workpiece, the prior art has not adequately addressed the problem of cavitation which causes undercutting of the workpiece due to air and cooling water collecting between the platen and the abrasive belt. The cavitation results from entrapped air and water creating small bubbles between the belt and platen which concentrates upstream of leading edges or immediately below cavities in the workpiece, causing uneven grinding in these edges of the workpiece. This problem is often aggravated by the accumulation of grinding debris between the belt and platen at these points.

Other prior art belt grinders which are even less pertinent than Kiser's are disclosed in the following U.S. Pat. Nos.: 2,679,128 and 2,586,848 to Miller; 3,266,197 to Olton; 4,290,240 to Robinson; 1,191,045 to Berwer; and 711,397 to Gronvold. The grinders disclosed in the Miller patents, particularly the embodiments of FIGS. 8 and 9 of the '848 Miller patent, are of interest in that they include a reciprocable platen having a plurality of parallel slots obliquely disposed with respect to the direction of travel of the belt. However, these slots are only disclosed as being one of a wide variety of designs possible to provide an impact edge which will cause edge or line contact between the abrasive belt and the workpiece, thereby prolonging the life of the abrasive belt. Thus, Miller's designs are not designed to facilitate cooling of the platen or the workpiece being ground, or to minimize the accumulation of air, water, or grinding debris between the underside of the belt and the platen.

Hence, it is a primary object of the present invention to provide an improved belt grinder which effectively and reliably overcomes the aforementioned drawbacks and limitations of the prior art proposals. More specifically, the present invention has as its objects one or more of the following taken individually or in combination:

1. To provide a belt grinder which, in a single grinding operation, can precision grind a workpiece constructed of either ferrous or nonferrous material;

2. The development of a platen for use with an abrasive belt grinder which incorporates cooling means for cooling and therefore preventing warpage of the platen and any workpiece ground thereby;

3. The provision of an apparatus and method for belt grinding a workpiece which reduces formation of bubbles and accumulation of grinding debris under the belt which can cause uneven grinding in the vicinity of the leading edges of the workpiece; and 4. To develop a platen for an abrasive belt grinder which permits water or any other cooling medium to drain therefrom, thus reducing the possibility of the cooling medium collecting between the platen and the underside of the belt.

SUMMARY OF THE INVENTION

This invention responds to the problems presented in the prior art by providing an abrasive belt grinder which includes the following components: (1) a pair of parallel, spaced rollers mounted to a table; (2) an endless abrasive belt mounted between the rollers, the upper portion of the belt defining a substantially planar grinding surface; and (3) a platen fixedly mounted under the upper portion of the abrasive belt to provide support for the workpiece, the platen including a plurality of parallel slots which are angled with respect to the direction of travel of the abrasive belt to facilitate cooling of the platen. In belt grinders using a liquid cooling medium, the angled slots also serve to drain water from the underside of the abrasive belt, thereby reducing the possibility of air and water being entrapped between the underside of the belt and the platen which could result in uneven grinding of the workpiece. They also minimize the accumulation of grinding debris which can aggravate such grinding problems. The angled slots may extend either perpendicularly or obliquely with respect to the direction of travel of the belt, although the preferred mode is an oblique disposition.

Another aspect of the invention is a platen which is adapted to be used with an abrasive belt grinder, comprising a plurality of slightly spaced apart, parallel, flat-topped bars extending from side to side to define the platen. The term "slightly spaced apart" as used herein is intended to define that spacing which is sufficient to permit drainage of any coolant from the underside of the belt and the platen, which will permit air to circulate between the bars to facilitate cooling of the platen and the workpiece, which permits thermal expansion of the bars to prevent or minimize warping of the bars, but which still presents a substantially uniform, planar, top surface.

A third aspect of the invention is a method for grinding a workpiece on an abrasive belt grinder which includes the step of placing a workpiece on the grinding surface to initiate grinding of the underside of the workpiece, displacing the workpiece from side to side along the grinding surface so that grinding is effected in a uniform fashion, and cooling the platen and the workpiece by permitting cooling fluid to circulate between the bars of the platen while grinding is taking place. The cooling fluid will normally comprise naturally circulating air, but other cooling means are facilitated by the novel platen design.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a peripheral view of one embodiment of the present invention showing the abrasive belt partially broken away to disclose the novel platen disposed below it;

FIG. 2 is an end elevational view taken along line 2—2 of FIG. 1;

FIG. 3 is a side elevational view of the platen depicted in FIG. 1; and

FIG. 4 is a plan view of the platen depicted in FIG. 1 incuding a phantomed reference line extending from one end to the other.

DESCRIPTION OF THE PREFERRED EMBODIMENT

The principles of this invention are particularly useful when embodied in a precision abrasive belt grinder such as that illustrated in FIGS. 1 and 2, generally indicated by the numeral 10. Belt grinder 10 includes a support table 12 which, in conjunction with a pair of parallel linear support frames 14 and 16 and a pair of transverse support frames 18 (only one of which shows on the figures), supports the grinding apparatus. A drive roller 20 and an idler roller 22 are journaled to opposite ends of linear support frames 14 and 16 by a drive roller bearing 24 and an idler roller bearing 26. A suitable drive mechanism including a drive motor 28 is provided to rotate drive roller 20 and thereby drive an endless abrasive belt 30 mounted between drive and idler rollers 20 and 22.

Linear support frames 14 and 16 are slotted (slots not shown) adjacent idler roller 22 to permit the idler roller to be displaced toward and away from drive roller 20, thereby permitting the tension in abrasive belt 30 to be varied and to facilitate removal and replacement of the belt. A typical tension adjusting means is depicted at 32 and includes a bearing block 34 slidably mounted between a pair of rails 36, a threaded spindle 38, and a pair of lock nuts 40 disposed at opposite sides of a stationary tensioner mounting block 42. An identical tension adjusting means is mounted to linear support frame 16, but does not show in FIG. 1.

A stop or fence 44 is mounted above abrasive belt 30 at the downstream or trailing end of the upper portion of belt grinder 10. Fence 44, which is cantilevered out over abrasive belt 30 from support table 12, thus defines the trailing edge of the planar grinding surface and maintains the workpiece 46 in position on the belt during grinding operations.

A pair of alignment bolts 50 and 52 with lock nuts 54 are threaded into linear support frame 14, to mount a pair of eccentric alignment cams 48 (only one of which shows) to grinder 10. This arrangement permits the platen, described in detail below, to be inclined with respect to the other components of belt grinder 10. Such inclination may be desirable in the event the floor upon which support table 12 rests is inclined. Alignment cam 48 is depicted in its normal, lowered position in FIG. 2, out of contact with the platen.

A coolant spray nozzle 55 is typically mounted to support table 12 in such a way that liquid coolant may be sprayed downwardly onto abrasive belt 30, thereby providing cooling for belt grinder 10. The control of liquid coolant through nozzle 55 is typically provided by a foot switch (not shown) of conventional design. Liquid coolant need not always be used with the depicted design, but one advantage of the invention is that it permits the use of liquid coolant without causing air and water bubbles and moist debris to collect between abrasive belt 30 and the platen.

The Platen

The platen, generally indicated at 56, is mounted to support table 12 immediately below the upper portion of abrasive belt 30. Its purpose is to provide support to the workpiece 46 being ground. Platen 56, which is depicted in isolation in FIGS. 3 and 4, includes a plurality of parallel bars 58 which are mounted to a pair of linear stringers 60 and 62, each of the bars being secured by a pair of bolts 64 which extend upwardly from the bottom of the stringers to threadably engage bars 58. A pair of transverse support members 66 and 68 extend between linear stringers 60 and 62 and are secured to the linear stringers by bolts 70. Platen 56 is thus a solid, integral structure which may be inserted and removed from belt grinder 10 as a unit. Expansion and contraction of the individual bars 58 of platen 56 is also made possible by this construction.

Each of the bars 58 which make up platen 56 includes at least one slot 72 which extends from one end of the bar to the other, substantially bisecting each of the bars with the exception of the end bars 58*a* and 58*b* which, in the depicted embodiment, include a pair of evenly spaced slots 72. As depicted best in FIG. 4, slots 72 are approximately the same width as the spacing between adjacent bars 58 which, in the preferred embodiment, is between ¼ and ½ inch.

The purposes of the multiple bar construction and slots 72 are basically the same; that is, to permit expansion and contraction of the bars, to permit air and/or other coolant to pass along bars 58 and to facilitate removal of coolant and grinding debris from between the underside of belt 30 and bars 58. The first two features promote dissipation of heat from the platen, thus inherently cooling the workpiece being ground, overcoming the concentration of heat in prior art designs which causes uneven thermal expansion of the workpiece and the platen. The third feature ensures that the abrasive belt will be in close contact with the platen, thus preventing undercutting of the workpiece adjacent apertures and leading edges thereof.

As depicted best in FIG. 4, bars 58 and their slots 72 extend at an oblique angle with respect to the direction of travel of abrasive belt 30, indicated by line 74 in FIG. 4. Alternate configurations may be possible, such as having the bars and slots extend perpendicularly with respect to the direction of travel (not shown). This is not the preferred mode, however, because the movement of abrasive belt 30 would not have the same tendency to clear out the liquid coolant and debris from spaces 59 and slots 72 as in the oblique embodiment. In another alternate configuration the bars and slots define a plurality of V's or chevrons, with each leg of the V or chevron extending parallel to several other legs so that the platen would still include a plurality of parallel slots.

When platen 56 is disposed in place in belt grinder 10, end bars 58*a* and 58*b* are supported by transverse support frames 18. In the event that platen 56 is inclined with respect to the other components of belt grinder 10, this support may not extend across the entire length of transverse support frames 18 due to the support provided by alignment cams 48. However, in its normal disposition, alignment cams 48 would be disposed as depicted, out of contact with bars 58 so that bars 58*a* and 58*b* are supported across the entire length of transverse support frames 18.

OPERATION OF THE DEPICTED EMBODIMENT

Grinding operations may be performed by belt grinder 10 by placing the workpiece 46 on abrasive belt 30 adjacent fence 44 and by starting drive motor 28. If desired, liquid coolant may be sprayed on abrasive belt 30 through nozzle 55. While grinding is taking place, the operator will typically move the workpiece from side to side along fence 44 to prevent any possibility of any uneven grinding due to the existence of spaces 59 between bars 58. The angulation of bars 58 and slots 72 ensures precise, even grinding when the side to side motion is imparted to the workpiece. The angulation of bars 58 and slots 72 also causes debris which might otherwise collect between the bars and in the slots to be carried gradually to the side of platen 56, or upwardly as depicted in FIG. 4. This feature would not exist if bars 58 extended perpendicularly across platen 56.

As grinding continues, heat will dissipate from platen 56 and therefore indirectly from workpiece 46 through spaces 59

Of course, it should be understood that various changes and modifications of the preferred embodiments described herein will be apparent to those skilled in the art. Such changes and modifications can be made without departing from the spirit and scope of the present invention and without diminishing its attended advantages. It is, therefore, intended that such changes and modifications be covered by the following claims.

I claim: between bars 58. Spaces 59 also prevent air, water and, more importantly, grinding debris from collecting between platen 56 and the underside of abrasive belt 30. In prior designs, the use of liquid coolant had a tendancy to exaggerate the accumulation of grinding debris; so the present invention permits the use of liquid coolant to be more widespread. This, of course, increases the rate of heat transfer from the workpiece, thereby minimizing the possibility of warpage which, as explained above, inherently results in uneven grinding.

1. An abrasive belt grinder for grinding a workpiece comprising:

a pair of sustantially horizontal, spaced rollers mounted to a table, at least one of said rollers being rotatably driven by drive means;

an endless abrasive belt which is mounted between said rollers and has upper and lower portions, said upper portion defining an upwardly facing, substantially planar grinding surface; and a platen fixedly mounted between said upper and lower portions of said abrasive belt to provide support for the workpiece, said platen comprising a plurality of separate, parallel slats with spaces therebetween, said spaces being elongated and angled with respect to the direction of travel of said abrasive belt.

2. The abrasive belt grinder of claim 1 wherein said spaces extend at an oblique angle with respect to the direction of travel of said belt.

3. The abrasive belt grinder of claim 1 wherein said slats are supported only at locations inwardly of their ends.

* * * * *

UNITED STATES PATENT AND TRADEMARK OFFICE

CERTIFICATE OF CORRECTION

PATENT NO. : 4,750,297

DATED : June 14, 1988

INVENTOR(S) : William J. Anderson

It is certified that error appears in the above-identified patent and that said Letters Patent is hereby corrected as shown below:

Column 6, line 14, after "spaces 59" insert -- between bars 58. Spaces 59 also prevent air, water, and, more importantly, grinding debris from collecting between platen 56 and the underside of abrasive belt 30. In prior designs, the use of liquid coolant had a tendency to exaggerate the accumulation of grinding debris; so the present invention permits the use of liquid coolant to be more widespread. This, of course, increases the rate of heat transfer from the workpiece, thereby minimizing the possibility of warpage which, as explained above, inherently results in uneven grinding.--

Col. 6, lines 23-32: After "I claim:" delete "between bars 58. Spaces 59 also prevent air, water, and, more importantly, grinding debris from collecting between platen 56 and the underside of abrasive belt 30. In prior designs, the use of liquid coolant had a tendency to exaggerate the accumulation of grinding debris; so the present invention

UNITED STATES PATENT AND TRADEMARK OFFICE

CERTIFICATE OF CORRECTION

PATENT NO. : 4,750,297

DATED : June 14, 1988

INVENTOR(S) : William J. Anderson

It is certified that error appears in the above-identified patent and that said Letters Patent is hereby corrected as shown below:

permits the use of liquid coolant to be more widespread. This, of course, increases the rate of heat transfer from the workpiece, thereby minimizing the possibility of warpage which, as explained above, inherently results in uneven grinding."

Signed and Sealed this

Eighth Day of November, 1988

*Attest:*

DONALD J. QUIGG

*Attesting Officer*

*Commissioner of Patents and Trademarks*